US007904292B2

(12) United States Patent
Goto et al.

(10) Patent No.: US 7,904,292 B2
(45) Date of Patent: Mar. 8, 2011

(54) SCALABLE ENCODING DEVICE, SCALABLE DECODING DEVICE, AND METHOD THEREOF

(75) Inventors: Michiyo Goto, Tokyo (JP); Koji Yoshida, Kanagawa (JP); Hiroyuki Ehara, Kanagawa (JP); Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 921 days.

(21) Appl. No.: 11/576,264

(22) PCT Filed: Sep. 28, 2005

(86) PCT No.: PCT/JP2005/017838

§ 371 (c)(1),
(2), (4) Date: Jun. 29, 2007

(87) PCT Pub. No.: WO2006/035810

PCT Pub. Date: Apr. 6, 2006

(65) Prior Publication Data

US 2008/0255833 A1 Oct. 16, 2008

(30) Foreign Application Priority Data

Sep. 30, 2004 (JP) ..... 2004-288327

(51) Int. Cl.
*G10L 19/12* (2006.01)
*G10L 19/00* (2006.01)

(52) U.S. Cl. ..... 704/219; 704/220; 704/223; 704/500

(58) Field of Classification Search ..... None
See application file for complete search history.

(56) References Cited

U.S. PATENT DOCUMENTS 4,815,132 A * 3/1989 Minami ..... 381/1

(Continued)

FOREIGN PATENT DOCUMENTS

EP 1489599 12/2004

(Continued)

OTHER PUBLICATIONS

ISO/IEC 14496-3:1999 (E) (B.14 Scalable AAC with core coder), ISO/IEC 1999.

(Continued)

*Primary Examiner* — Matthew J Sked
(74) *Attorney, Agent, or Firm* — Greenblum & Bernstein P.L.C.

(57) ABSTRACT

A scalable encoding device for realizing scalable encoding by CELP encoding of a stereo sound signal and improving the encoding efficiency. In this device, an adder and a multiplier obtain an average of a first channel signal CH1 and a second channel signal CH2 as a monaural signal M. A CELP encoder for a monaural signal subjects the monaural signal M to CELP encoding, outputs the obtained encoded parameter to outside, and outputs a synthesized monaural signal M' synthesized by using the encoded parameter to a first channel signal encoder. By using the synthesized monaural signal M' and the second channel signal CH2, the first channel signal encoder subjects the first channel signal CH1 to CELP encoding to minimize the sum of the encoding distortion of the first channel signal CH1 and the encoding distortion of the second channel signal CH2.

18 Claims, 8 Drawing Sheets

U.S. PATENT DOCUMENTS

| | | | | |
|---|---|---|---|---|
| 5,737,484 | A | 4/1998 | Ozawa | |
| 6,122,338 | A | 9/2000 | Yamauchi | |
| 6,345,246 | B1 * | 2/2002 | Moriya et al. | 704/219 |
| 6,393,392 | B1 * | 5/2002 | Minde | 704/220 |
| 6,629,078 | B1 | 9/2003 | Grill et al. | |
| 6,973,184 | B1 * | 12/2005 | Shaffer et al. | 379/420.01 |
| 2003/0191635 | A1 | 10/2003 | Minde et al. | |
| 2005/0149322 | A1 * | 7/2005 | Bruhn et al. | 704/211 |

FOREIGN PATENT DOCUMENTS

| | | |
|---|---|---|
| JP | 6-222797 | 8/1994 |
| JP | 6-259097 | 9/1994 |
| JP | 9-261065 | 10/1997 |
| JP | 10-105193 | 4/1998 |
| JP | 10-143199 | 5/1998 |
| JP | 2003-099095 | 4/2003 |
| JP | 2003-323199 | 11/2003 |
| WO | 02/23529 | 3/2002 |

OTHER PUBLICATIONS

U.S. Appl. No. 11/573,761 to Ehara et al., filed Feb. 15, 2007.
U.S. Appl. No. 11/718,437 to Ehara et al., filed May 2, 2007.
U.S. Appl. No. 11/576,659 to Oshikiri, filed Apr. 4, 2007.
U.S. Appl. No. 11/577,816 to Oshikiri, filed Apr. 24, 2007.
U.S. Appl. No. 11/570,004 to Goto et al., filed Mar. 26, 2007.
Goto et al., "Onsei Tsushinyo Scalable Stereo Onsei Fukugoka Hoho no Kento: A study of scalable stereo speech coding for speech communications," Forum on Information Technology Ippan Koen Runbunshu, XX, XX, No. G-17, Aug. 22, 2005, pp. 299-300, XP003011997.
Ramprashad, "Stereophonic celp coding using cross channel prediction," Speech Coding, 2000, Proceedings, 2000 IEEE Workshop on Sep. 17-20, 2000, Piscataway, NJ, USA, IEEE, Sep. 17, 2000, pp. 136-13, XP010520067.

* cited by examiner

SCALABLE ENCODING DEVICE, SCALABLE DECODING DEVICE, AND METHOD THEREOF

TECHNICAL FIELD

The present invention relates to a scalable encoding apparatus that performs scalable encoding on a stereo speech signal using a CELP method (hereinafter referred to simply as CELP encoding), a scalable decoding apparatus, and a method used by the scalable encoding apparatus and scalable decoding apparatus.

BACKGROUND ART

In speech communication of a mobile communication system, communication using a monaural scheme (monaural communication) is a mainstream, such as communication using mobile telephones. However, if a transmission rate increases further as in the fourth-generation mobile communication system, it is possible to maintain an adequate bandwidth for transmitting a plurality of channels. It is therefore expected that communication using a stereo system (stereo communication) will be widely used in speech communication as well.

For example, considering the increasing number of users who enjoy stereo music by storing music in portable audio players that are equipped with a HDD (hard disk) and attaching stereo earphones, headphones, or the like to the player, it is anticipated that mobile telephones will be combined with music players in the future, and that a lifestyle of using stereo earphones, headphones, or other equipments and performing speech communication using a stereo system will become prevalent. In order to realize realistic conversation in the environment such as in currently popularized TV conference, it is anticipated that stereo communication is used.

Even when stereo communication becomes common, it is assumed that monaural communication will also be used. This is because monaural communication has a low bit rate, and a lower cost of communication can therefore be expected. Further, a mobile telephone which supports only monaural communication has a smaller circuit scale and is therefore inexpensive. Users who do not need high-quality speech communication will purchase mobile telephones which support only monaural communication. Accordingly, in a single communication system, mobile telephones which support stereo communication and mobile telephones which support monaural communication will coexist. Therefore, the communication system will have to support both stereo communication and monaural communication.

In the mobile communication system, communication data is exchanged using radio signals, a part of the communication data is sometimes lost according to the propagation path environment. Therefore, if the mobile telephone has a function of restoring the original communication data from the residual received data even in this case, it is extremely useful.

There is scalable encoding composed of a stereo signal and a monaural signal. This type of encoding can support both stereo communication and monaural communication and is capable of restoring the original communication data from residual received data even when a part of the communication data is lost. An example of a scalable encoding apparatus that has this function is disclosed in Non-patent Document 1, for example.

Non-patent Document 1: ISO/IEC 14496-3:1999 (B.14 Scalable AAC with core coder)

DISCLOSURE OF INVENTION

Problems to Be Solved by the Invention

However, the scalable encoding apparatus disclosed in Non-patent Document 1 is designed for an audio signal and does not assume a speech signal, and therefore there is a problem of decreasing encoding efficiency when the scalable encoding is applied to a speech signal as is. Specifically, for a speech signal, it is required to apply CELP encoding which is capable of efficient encoding, but Non-patent Document 1 does not disclose the specific configuration for the case where a CELP method is applied, particularly where CELP encoding is applied in an extension layer. Even when CELP encoding optimized for the speech signal which is not assumed to that apparatus is applied as is, the desired encoding efficiency is difficult to obtain.

It is therefore an object of the present invention to provide a scalable encoding apparatus capable of realizing scalable encoding of a stereo speech signal using a CELP method and improving encoding efficiency, a scalable decoding apparatus, and a method used by the scalable encoding apparatus and scalable decoding apparatus.

Means for Solving the Problem

The scalable encoding apparatus of the present invention has: a generating section that generates a monaural speech signal from a stereo speech signal that includes a first channel signal and a second channel signal; a monaural encoding section that encodes the monaural speech signal using a CELP method; a calculating section that calculates encoding distortion of the second channel signal that occurs by the CELP encoding; and a first encoding section that encodes the first channel signal using the CELP method and obtains an encoded parameter of the first channel signal so as to minimize the sum of the encoding distortion of the first channel signal that occurs in the encoding, and the encoding distortion of the second channel signal calculated by the calculating section.

ADVANTAGES EFFECT OF THE INVENTION

According to the present invention, it is possible to perform scalable encoding of a stereo speech signal using CELP encoding and improve encoding efficiency.

BEST MODE FOR CARRYING OUT THE INVENTION

Embodiments of the present invention will be described in detail hereinafter with reference to the accompanying drawings. The case will be described as an example where the stereo speech signal formed with two channels is encoded, wherein the first channel and the second channel described hereinafter are an L channel and an R channel, respectively, or an R channel and an L channel, respectively.

Embodiment 1

Figure 1:
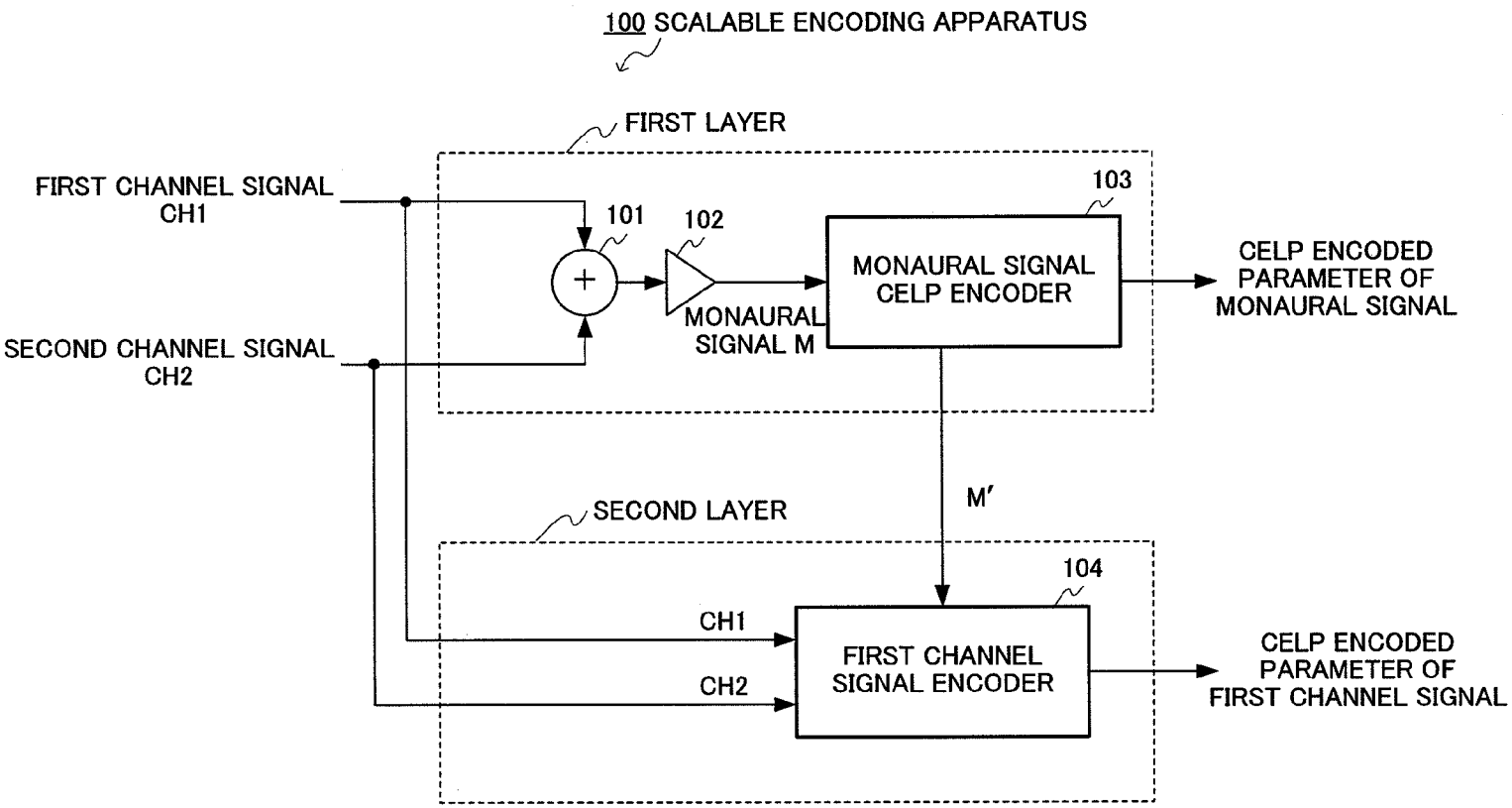
FIG. 1 is a block diagram showing the main configuration of the scalable encoding apparatus according to embodiment 1.

FIG. 1 is a block diagram showing the main configuration of scalable encoding apparatus 100 according to embodiment 1 of the present invention. Scalable encoding apparatus 100 is provided with adder 101, multiplier 102, monaural signal CELP encoder 103 and first channel signal encoder 104.

Each section of scalable encoding apparatus 100 performs the operation described below.

Adder 101 adds first channel signal CH1 and second channel signal CH2 which are inputted to scalable encoding apparatus 100 to generate a sum signal. Multiplier 102 multiplies the sum signal by ½ to divide the scale in half and generates monaural signal M. Specifically, adder 101 and multiplier 102 calculate the average signal of first channel signal CH1 and second channel signal CH2 and set the average signal as monaural signal M.

Monaural signal CELP encoder 103 performs CELP encoding on monaural signal M and outputs a CELP encoded parameter obtained for each sub-frame to outside of scalable encoding apparatus 100. Monaural signal CELP encoder 103 outputs synthesized monaural signal M', which is synthesized (for each sub-frame) using the CELP encoded parameter for each sub-frame, to first channel signal encoder 104. The term "CELP encoded parameter" used herein is an LPC (LSP) parameter, an adaptive excitation codebook index, an adaptive excitation gain, a fixed excitation codebook index and a fixed excitation gain.

First channel signal encoder 104 performs encoding described later on first channel signal CH1 inputted to scalable encoding apparatus 100 using second channel signal CH2 inputted to scalable encoding apparatus 100 in the same way and synthesized monaural signal M' outputted from monaural signal CELP encoder 103, and outputs the CELP encoded parameter of the obtained first channel signal to outside of scalable encoding apparatus 100.

One of the characteristics of scalable encoding apparatus 100 is that adder 101, multiplier 102, and monaural signal CELP encoder 103 form a first layer, and first channel signal encoder 104 forms a second layer, wherein the encoded parameter of the monaural signal is outputted from the first layer, and the encoded parameter with which a stereo signal can be obtained by decoding together with a decoded signal of the first layer (monaural signal) at the decoding side is outputted from the second layer. Specifically, the scalable encoding apparatus according to this embodiment performs scalable encoding that is composed of a monaural signal and a stereo signal.

According to this configuration, the decoding apparatus which acquires the encoded parameters composed of the above mentioned first layer and second layer can decode a monaural signal although at a low quality, even if the decoding apparatus cannot acquire the encoded parameter of the second layer and can only acquire the encoded parameter of the first layer due to deterioration of the transmission path environment. When the decoding apparatus can acquire the encoded parameters of the first layer and second layer, it is possible to decode a stereo signal at a high quality using these parameters.

The principle by which the decoding apparatus can decode a stereo signal using the encoded parameters of the first layer and second layer outputted from scalable encoding apparatus 100 will be described hereinafter. FIG. 2 shows the relationship of the monaural signal, the first channel signal and the second channel signal.

Figures 2A, 2B:
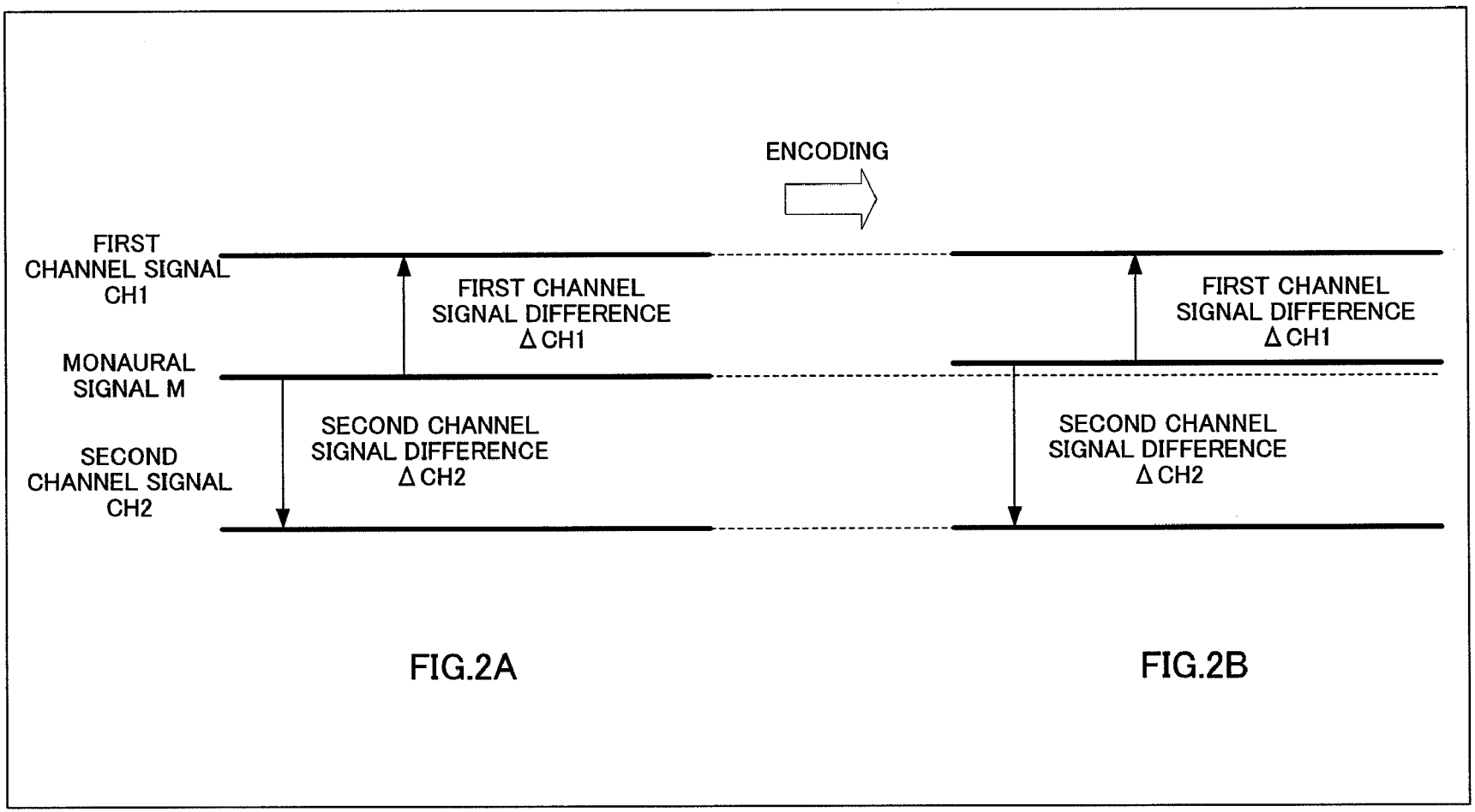
FIG. 2 shows the relationship of the monaural signal, the first channel signal and the second channel signal.

As shown in FIG. 2A, monaural signal M prior to encoding can be calculated by multiplying the sum of first channel signal CH1 and second channel signal CH2 by ½, that is, by the following Equation (1).

$$M=(CH1+CH2)/2 \quad \text{(Equation 1)}$$

Therefore, second channel signal CH2 can be calculated when monaural signal M and first channel signal CH1 are known.

However, in reality, when monaural signal M and first channel signal CH1 are encoded, encoding distortion occurs as a result of encoding, and therefore, Equation (1) no longer holds. More specifically, when the difference between first channel signal CH1 and monaural signal M is referred to as first channel signal difference ΔCH1, and the difference between second channel signal CH2 and monaural signal M is referred to as second channel signal difference ΔCH2, a difference occurs between ΔCH1 and ΔCH2 as shown in FIG. 2B as a result of encoding, and the relationship of Equation (1) is no longer satisfied. Therefore, even when monaural signal M and first channel signal CH1 can be obtained by decoding, it is subsequently no longer possible to correctly calculate second channel signal CH2. In order to prevent the degradation of the speech quality of the decoded signal, it is necessary to consider an encoding method taking into consideration the difference between the two encoding distortions.

In order to further improve the decoding accuracy of CH1 and CH2, scalable encoding apparatus 100 according to this embodiment minimizes the encoding distortion of CH1 upon encoding of CH1 so that the encoding distortion of CH2 is minimized, and determines the encoded parameter of CH1. By this means, it is possible to prevent the degradation of the speech quality of the decoded signal.

On the other hand, the decoded CH2 is generated in the decoding apparatus from the decoded signal of CH1 and the decoded signal of the monaural signal. Equation (2) below is obtained from the above Equation (1), and CH2 can therefore be generated according to Equation (2).

$$CH2=2\times M-CH1 \quad \text{(Equation 2)}$$

Figure 3:
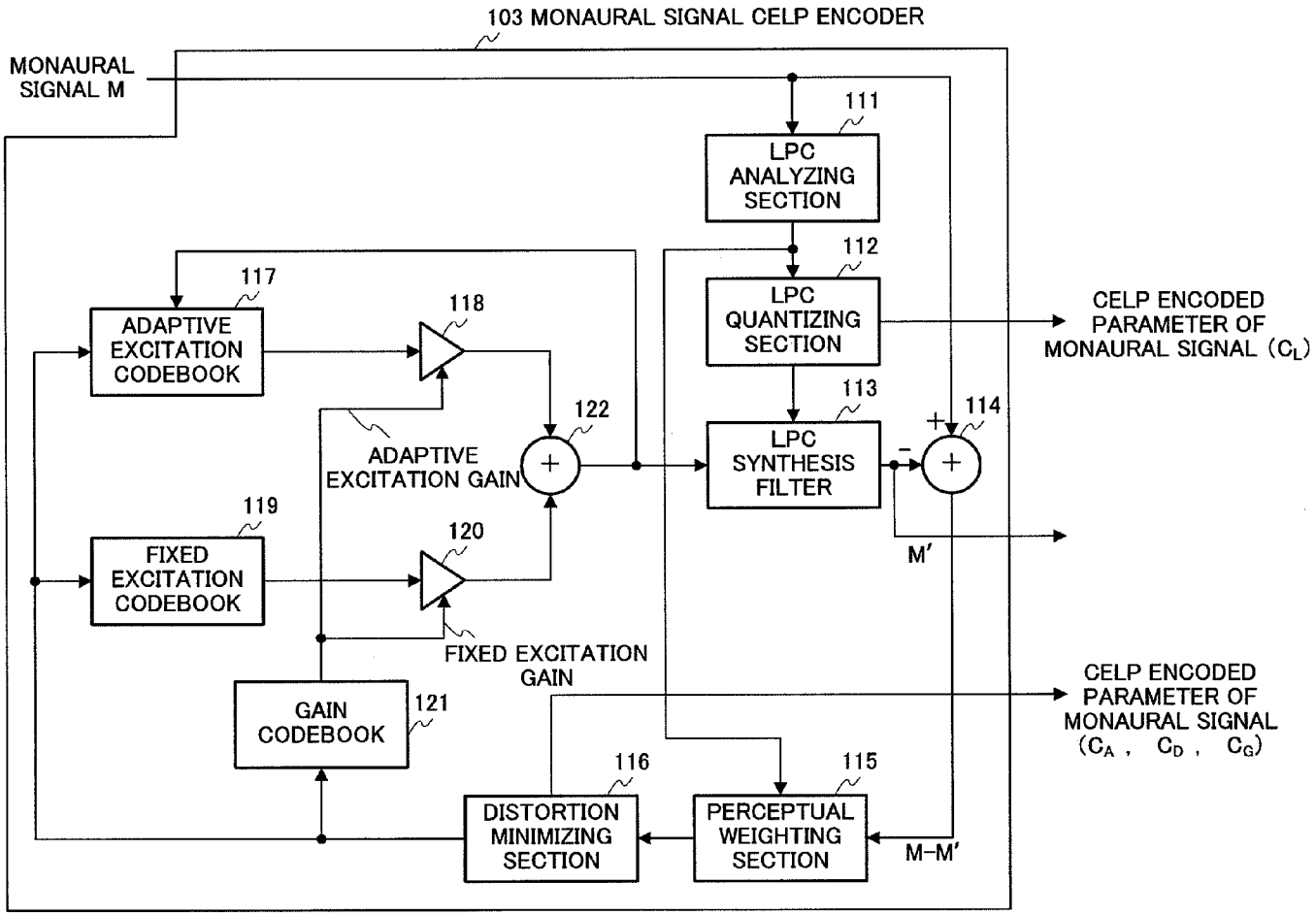
FIG. 3 is a block diagram showing the main internal configuration of the monaural signal CELP encoder according to embodiment 1.

FIG. 3 is a block diagram showing the main internal configuration of monaural signal CELP encoder 103.

Monaural signal CELP encoder 103 is provided with LPC analyzing section 111, LPC quantizing section 112, LPC synthesis filter 113, adder 114, perceptual weighting section 115, distortion minimizing section 116, adaptive excitation codebook 117, multiplier 118, fixed excitation codebook 119, multiplier 120, gain codebook 121 and adder 122.

LPC analyzing section 111 performs linear prediction analysis on monaural signal M outputted from multiplier 102, and outputs the LPC parameter which is the analysis result to LPC quantizing section 112 and perceptual weighting section 115.

LPC quantizing section 112 quantizes the LSP parameter after converting the LPC parameter outputted from LPC analyzing section 111 to an LSP parameter which is suitable for quantization, and outputs the obtained quantized LSP parameter (CL) to outside of monaural signal CELP encoder 103. The quantized LSP parameter is one of the CELP encoded parameters obtained by monaural signal CELP encoder 103. LPC quantizing section 112 reconverts the quantized LSP parameter to a quantized LPC parameter, and outputs the quantized LPC parameter to LPC synthesis filter 113.

LPC synthesis filter 113 uses the quantized LPC parameter outputted from LPC quantizing section 112 to perform synthesis by LPC synthesis filter using an excitation vector generated by adaptive excitation codebook 117 and fixed excitation codebook 119 (described hereinafter) as excitation. The obtained synthesized signal M' is outputted to adder 114 and first channel signal encoder 104.

Adder 114 inverts the polarity of the synthesized signal outputted from LPC synthesis filter 113, calculates an error signal by adding to monaural signal M, and outputs the error signal to perceptual weighting section 115. This error signal corresponds to the encoding distortion.

Perceptual weighting section 115 uses a perceptual weighting filter configured based on the LPC parameter outputted from LPC analyzing section 111 to perform perceptual weighting for the encoding distortion outputted from adder 114, and the signal is outputted to distortion minimizing section 116.

Distortion minimizing section 116 indicates various types of parameters to adaptive excitation codebook 117, fixed excitation codebook 119 and gain codebook 121 so as to minimize the encoding distortion that is outputted from perceptual weighting section 115. Specifically, distortion minimizing section 116 indicates indices ($C_A$, $C_D$, $C_G$) to adaptive excitation codebook 117, fixed excitation codebook 119 and gain codebook 121.

Adaptive excitation codebook 117 stores the previously generated excitation vector for LPC synthesis filter 113 in an internal buffer, generates a single sub-frame portion from the stored excitation vector based on an adaptive excitation lag that corresponds to the index indicated from distortion minimizing section 116, and outputs the single sub-frame portion to multiplier 118 as an adaptive excitation vector.

Fixed excitation codebook 119 outputs the excitation vector, which corresponds to the index indicated from distortion minimizing section 116, to multiplier 120 as a fixed excitation vector.

Gain codebook 121 generates a gain that corresponds to the index indicated from distortion minimizing section 116, that is, a gain for the adaptive excitation vector from adaptive excitation codebook 117, and a gain for the fixed excitation vector from fixed excitation codebook 119, and outputs the gains to multipliers 118 and 120.

Multiplier 118 multiplies the adaptive excitation gain outputted from gain codebook 121 by the adaptive excitation vector outputted from adaptive excitation codebook 117, and outputs the result to adder 122.

Multiplier 120 multiplies the fixed excitation gain outputted from gain codebook 121 by the fixed excitation vector outputted from fixed excitation codebook 119, and outputs the result to adder 122.

Adder 122 adds the adaptive excitation vector outputted from multiplier 118 and the fixed excitation vector outputted from multiplier 120, and outputs the added excitation vector as excitation to LPC synthesis filter 113. Adder 122 also feeds back the obtained excitation vector of the excitation to adaptive excitation codebook 117.

As previously described, the excitation vector outputted from adder 122, that is, the excitation vector generated by adaptive excitation codebook 117 and fixed excitation codebook 119, is synthesized as excitation by LPC synthesis filter 113.

In this way, a series of processing of obtaining the encoding distortion using the excitation vectors generated by adaptive excitation codebook 117 and fixed excitation codebook 119 is a closed loop (feedback loop). Distortion minimizing section 116 indicates adaptive excitation codebook 117, fixed excitation codebook 119, and gain codebook 121 so as to minimize the encoding distortion. Distortion minimizing section 116 outputs various types of CELP encoded parameters ($C_A$, $C_D$, $C_G$) that minimize the encoding distortion to outside of scalable encoding apparatus 100.

Figure 4:
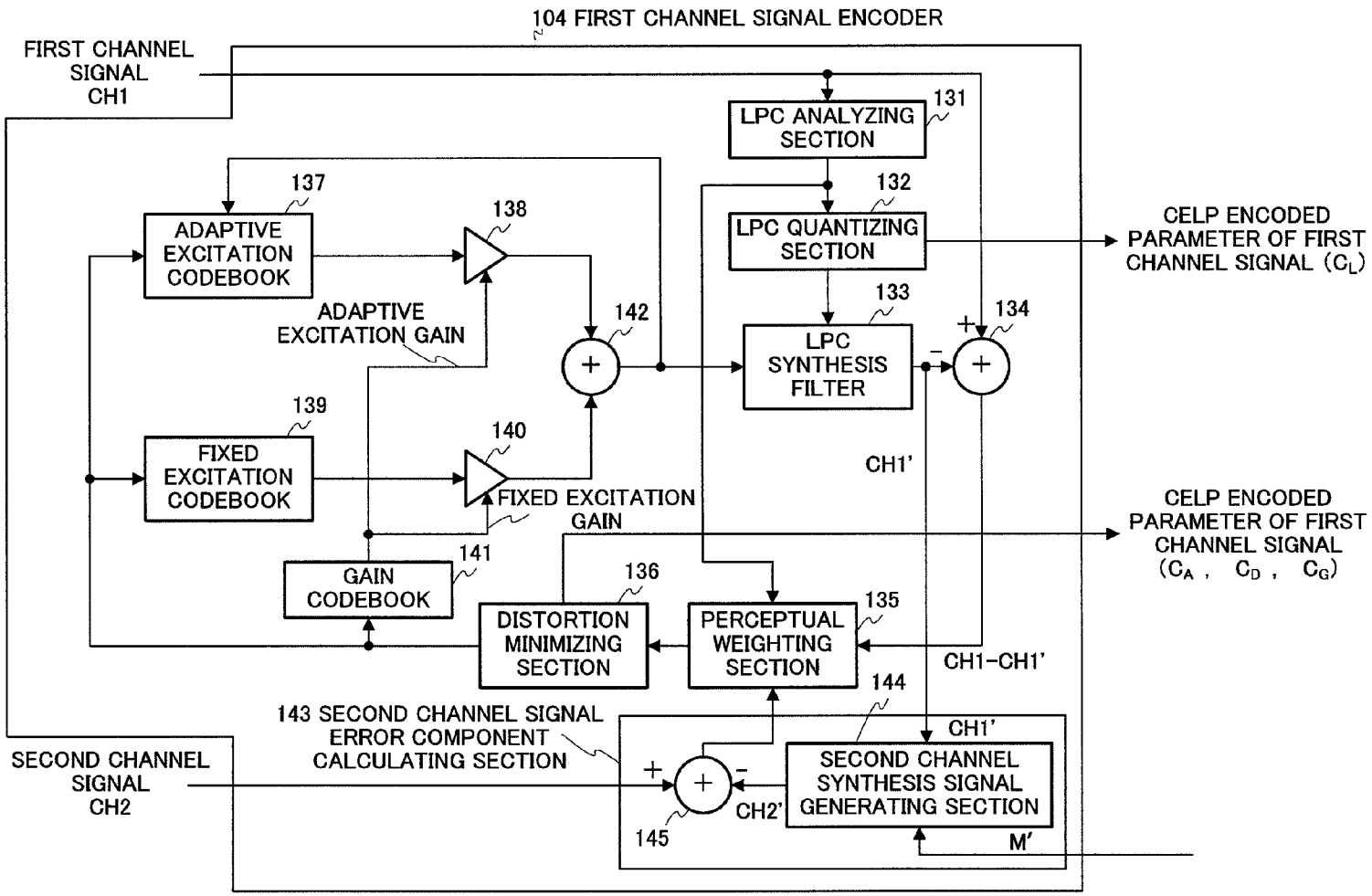
FIG. 4 is a block diagram showing the main internal configuration of the first channel signal encoder according to embodiment 1.

FIG. 4 is a block diagram showing the main internal configuration of first channel signal encoder 104.

In first channel signal encoder 104, the configurations of LPC analyzing section 131, LPC quantizing section 132, LPC synthesis filter 133, adder 134, distortion minimizing section 136, adaptive excitation codebook 137, multiplier 138, fixed excitation codebook 139, adder 140, gain codebook 141 and adder 142 are the same as those of LPC analyzing section 111, LPC quantizing section 112, LPC synthesis filter 113, adder 114, distortion minimizing section 116, adaptive excitation codebook 117, multiplier 118, fixed excitation codebook 119, multiplier 120, gain codebook 121 and adder 122 in monaural signal CELP encoder 103. These components are therefore not described.

Second channel signal error component calculating section 143 is an entirely new component. The basic operations of perceptual weighting section 135 and distortion minimizing section 136 are the same as those of perceptual weighting section 115 and distortion minimizing section 116 in monaural signal CELP encoder 103. However, perceptual weighting section 135 and distortion minimizing section 136 receive the output of second channel signal error component calculating section 143 and perform operations that differ from those of monaural signal CELP encoder 103 as described below.

When CH1 is encoded in a second layer, that is, in first channel signal encoder 104, scalable encoding apparatus 100 according to this embodiment decides an encoded parameter of CH1 so as to minimize the sum of the encoding distortion of CH1 and the encoding distortion of CH2. A high-quality speech can thereby be achieved by simultaneously optimizing the encoding distortions of CH1 and CH2.

Second channel signal error component calculating section 143 calculates an error component for a case where CELP encoding is temporarily performed on the second channel signal, that is, calculates the above-described encoding distortion of CH2. Specifically, second channel synthesis signal generating section 144 in second channel signal error component calculating section 143 calculates a synthesized second channel signal CH2' by doubling synthesized monaural signal M' and subtracting synthesized first channel signal CH1' from the calculated value. Second channel synthesis signal generating section 144 does not perform CELP encoding of the second channel signal. Adder 145 then calculates the difference between second channel signal CH2 and synthesized second channel signal CH2'.

Perceptual weighting section 135 performs perceptual weighting on the difference between first channel signal CH1 and synthesized first channel signal CH1', that is, the encoding distortion of the first channel, in the same way as perceptual weighting section 115 in monaural signal CELP encoder 103. Perceptual weighting section 135 also performs perceptual weighting of the difference between second channel signal CH2 and synthesized second channel signal CH2', that is, the encoding distortion of the second channel.

Distortion minimizing section 136 decides the optimal adaptive excitation vector, the fixed excitation vector and the gain of the vectors using the algorithm described below so as to minimize the perceptual-weighted encoding distortion, that is, the sum of the encoding distortion for the first channel signal and the encoding distortion for the second channel signal.

Hereinafter, the algorithm used in distortion minimizing section 136 which minimizes encoding distortion will be described. CH1 and CH2 are input signals, CH1' is the synthesized signal of CH1, CH2' is the synthesized signal of CH2, and M' is the synthesized monaural signal.

Sum d of the encoding distortions of the first channel signal and the second channel signal can be expressed by Equation (3) below.

$$d=\|CH1-CH1'\|^2+\|CH2-CH2'\|^2 \quad \text{(Equation 3)}$$

From the relationship of the monaural signal, the first channel signal and the second channel signal, CH2' can be expressed by already-encoded monaural synthesized signal M' and first channel synthesized signal CH1' as shown in Equation (4) below.

$$CH2'=2\times M'-CH1' \quad \text{(Equation 4)}$$

Equation (3) can thus be rewritten as Equation (5) below.

$$d=\|CH1-CH1'\|^2+\|CH2-(2\times M'-CH1')\|^2 \quad \text{(Equation 5)}$$

Specifically, the scalable encoding apparatus according to this embodiment obtains through search the CELP encoded parameter of the first channel signal for obtaining CH1' that minimizes encoding distortion d expressed by Equation (5).

Specifically, the LPC parameter for the first channel is first analyzed/quantized. The adaptive excitation codebook, the fixed excitation codebook and the excitation gain are then searched so as to minimize the encoding distortion expressed by Equation (5) above, and an adaptive excitation codebook index, a fixed excitation codebook index and an excitation gain index are determined.

Specifically, although the sum of the encoding distortion of CH1 and the encoding distortion of CH2 is minimized, it is only necessary to consider the encoding distortion of CH1 in the process of encoding. The encoding distortion for CH2 is thereby simultaneously considered.

By optimizing the encoding (adaptive excitation codebook index and fixed excitation codebook index) of the first channel parameter, it is possible to perform encoding so as to minimize the encoding distortion not only for the first channel signal, but also for the second channel signal.

Another variation of the algorithm used in distortion minimizing section 136 that minimizes the encoding distortion will next be described. A case will be described where the encoding distortion of the first channel signal and the encoding distortion of the second channel signal are weighted in accordance with the degree of accuracy when it is desired that the encoding distortion of the first channel signal and the encoding distortion of the second channel signal are perceptual-weighted at perceptual weighting section 135, and either of the channel signals is encoded at high accuracy. Herein, $\alpha$ and $\beta$ are weighting coefficients with respect to the encoding distortion of perceptual-weighted CH1 and CH2, respectively.

Sum d' of the encoding distortions for the first channel signal and the second channel signal is expressed by Equation (6) below.

$$d'=\alpha\times\|CH1-CH1'\|^2+\beta\times\|CH2-CH2'\|^2 \quad \text{(Equation 6)}$$

From the relationship of the monaural signal, the first channel signal and the second channel signal, CH2' can be expressed by already-encoded monaural synthesized signal M' and first channel synthesized signal CH1' as shown in Equation (7) below.

$$CH2'=2\times M'-CH1' \quad \text{(Equation 7)}$$

Equation (6) thus becomes Equation (8) below.

$$d'=\alpha\times\|CH1-CH1'\|^2+\beta\times\|CH2-(2\times M'-CH1')\|^2 \quad \text{(Equation 8)}$$

The scalable encoding apparatus according to this embodiment obtains through search the first channel CELP encoded parameter so as to obtain CH1' that minimizes encoding distortion d' expressed by Equation (8).

Specifically, the LPC parameter for the first channel is first analyzed/quantized. The adaptive excitation codebook, the fixed excitation codebook and the excitation gain are then searched so as to minimize the encoding distortion expressed by Equation (8) above, and an adaptive excitation codebook index, a fixed excitation codebook index and a excitation gain index are determined.

Specifically, although the sum of the encoding distortion of CH1 and the encoding distortion of CH2 is minimized, it is only necessary to consider the encoding distortion of CH1 in the process of encoding. The encoding distortion for CH2 is thereby simultaneously considered.

Simultaneous consideration herein does not necessarily mean that the encoding distortions are considered in equal ratios. For example, when the first channel signal and the second channel signal are completely independent signals (for example, a speech signal and a separate music signal, the speech by person A and the speech by person B, or another case), and higher accuracy encoding of the first channel signal is desired, by setting weighting coefficient $\alpha$ for the distortion signal of the first channel signal so as to be larger than $\beta$, it is possible to make the distortion of the first channel signal smaller than the second channel signal.

In this way, by optimizing the encoding (adaptive excitation codebook index and fixed excitation codebook index) of the first channel parameter, it is possible to perform encoding so as to minimize the encoding distortion not only for the first channel signal, but also for the second channel signal.

The values of $\alpha$ and $\beta$ may be determined by preparing the values in advance in a table according to a type of the input signal (such as a speech signal and a music signal), or the values may be determined by calculating an energy ratio of signals in a fixed interval (such as frame and sub-frame).

Figure 5:
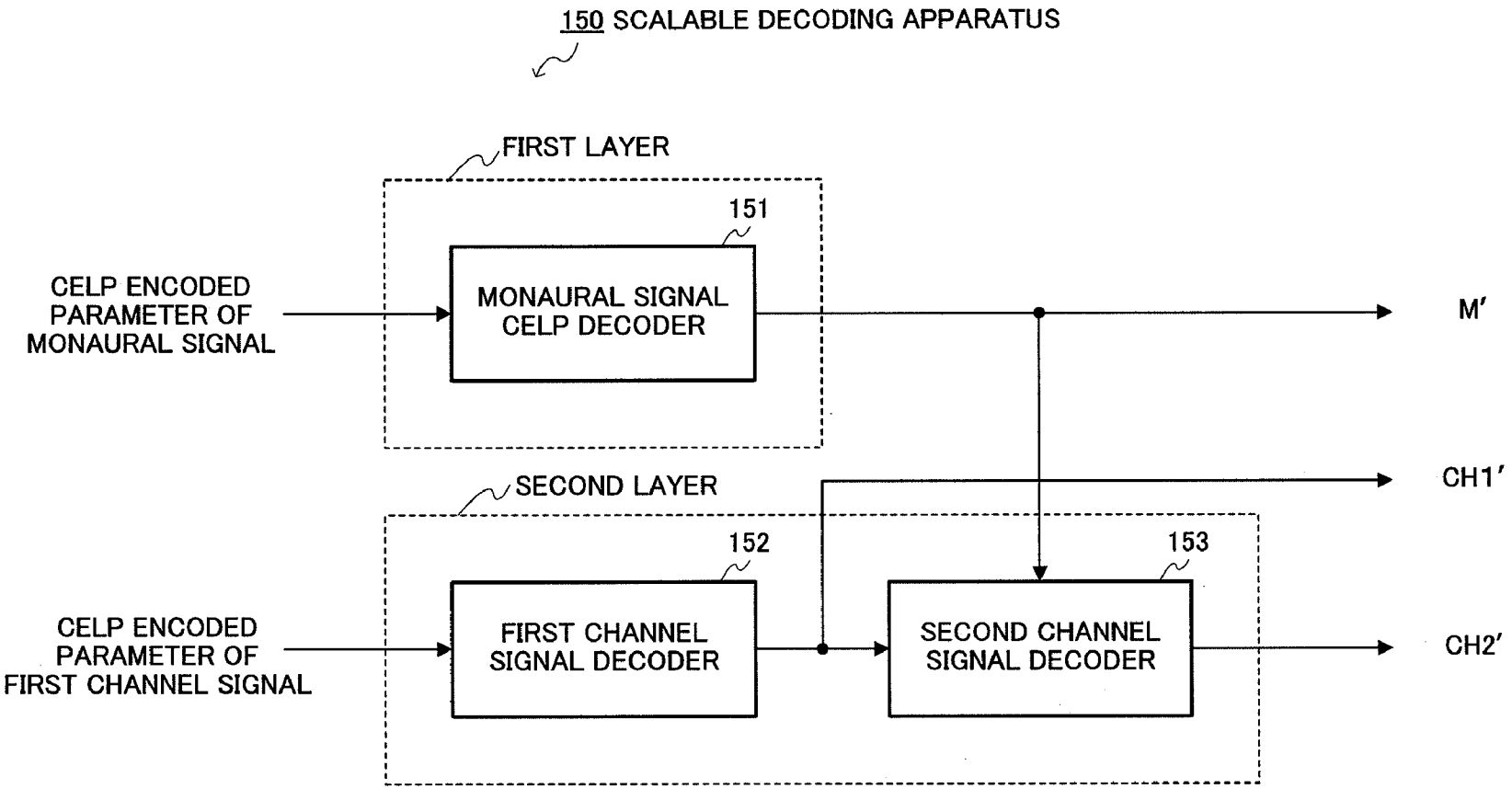
FIG. 5 is a block diagram showing the main configuration of the scalable decoding apparatus according to embodiment 1.

FIG. 5 is a block diagram showing the main configuration of scalable decoding apparatus 150 that decodes the encoded parameter generated by scalable encoding apparatus 100, that is, corresponds to scalable encoding apparatus 100.

Monaural signal CELP decoder 151 synthesizes monaural signal M' from the CELP encoded parameter of the monaural signal. First channel signal decoder 152 synthesizes the first channel signal CH1' from the CELP encoded parameter of the first channel signal.

Second channel signal decoder 153 calculates second channel signal CH2' according to Equation (9) below from monaural signal M' and first channel signal CH1'.

$$CH2'=2\times M'-CH1' \quad \text{(Equation 9)}$$

According to this embodiment, when CH1 is encoded, the encoded parameter of CH1 is determined so as to minimize the sum of the encoding distortion of CH1 and the encoding distortion of CH2, so that it is possible to improve the decoding accuracy of CH1 and CH2 and prevent the degradation of the speech quality of the decoded signal.

In this embodiment, the encoded parameter of CH1 is determined so as to minimize the sum of the encoding distortion of CH1 and the encoding distortion of CH2, but the encoded parameter of CH1 may also be determined so as to minimize both the encoding distortion of CH1 and the encoding distortion of CH2.

Embodiment 2

Figure 6:
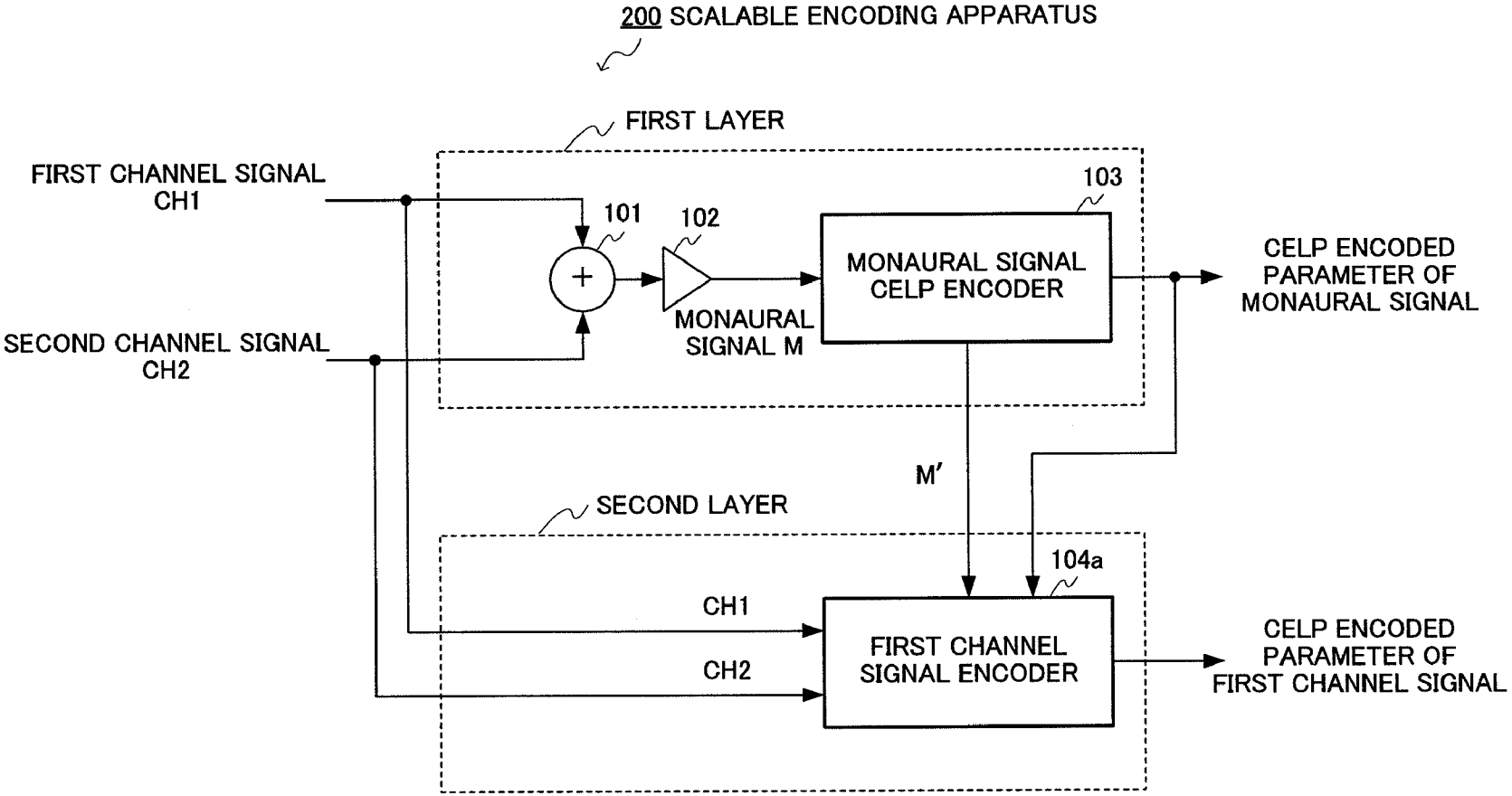
FIG. 6 is a block diagram showing the main configuration of the scalable encoding apparatus according to embodiment 2.

FIG. 6 is a block diagram showing the main configuration of scalable encoding apparatus 200 according to embodiment 2 of the present invention. Scalable encoding apparatus 200 has the same basic configuration as scalable encoding apparatus 100 of embodiment 1. Components that are the same will be assigned the same reference numerals without further explanations.

In this embodiment, when CH1 is encoded in the second layer, a difference parameter of CH1 relative to the monaural signal is encoded. More specifically, first channel signal encoder 104*a* performs encoding in accordance with CELP encoding, that is, encoding using linear prediction analysis and adaptive excitation codebook search, on the first channel signal CH1 inputted to scalable encoding apparatus 200, and obtains a difference parameter between an encoded parameter obtained in the process and a CELP encoded parameter of the monaural signal outputted from monaural signal CELP encoder 103. When this encoding is also referred to simply as CELP encoding, the above-described processing corresponds to obtaining a difference in the level (stage) of the CELP encoded parameter for monaural signal M and first channel signal CH1. First channel signal encoder 104*a* encodes the above-described difference parameter. By this means, the difference parameter is quantized, so that it is possible to perform more efficient encoding.

In the same way as in embodiment 1, monaural signal CELP encoder 103 performs CELP encoding on the monaural signal generated from the first channel signal and the second channel signal, and extracts and outputs a CELP encoded parameter of the monaural signal. The CELP encoded parameter of the monaural signal is also inputted to first channel signal encoder 104*a*. Monaural signal CELP encoder 103 also outputs synthesized monaural signal M' to first channel signal encoder 104*a*.

The input of first channel signal encoder 104*a* is first channel signal CH1, second channel signal CH2, synthesized monaural signal M', and the CELP encoded parameter of the monaural signal. First channel signal encoder 104*a* encodes the difference between the first channel signal and the monaural signal and outputs the CELP encoded parameter of the first channel signal. The monaural signal herein is already CELP-encoded, and the encoded parameter is extracted. Therefore, the CELP encoded parameter of the first channel signal is the difference parameter with respect to the CELP encoded parameter of the monaural signal.

Figure 7:
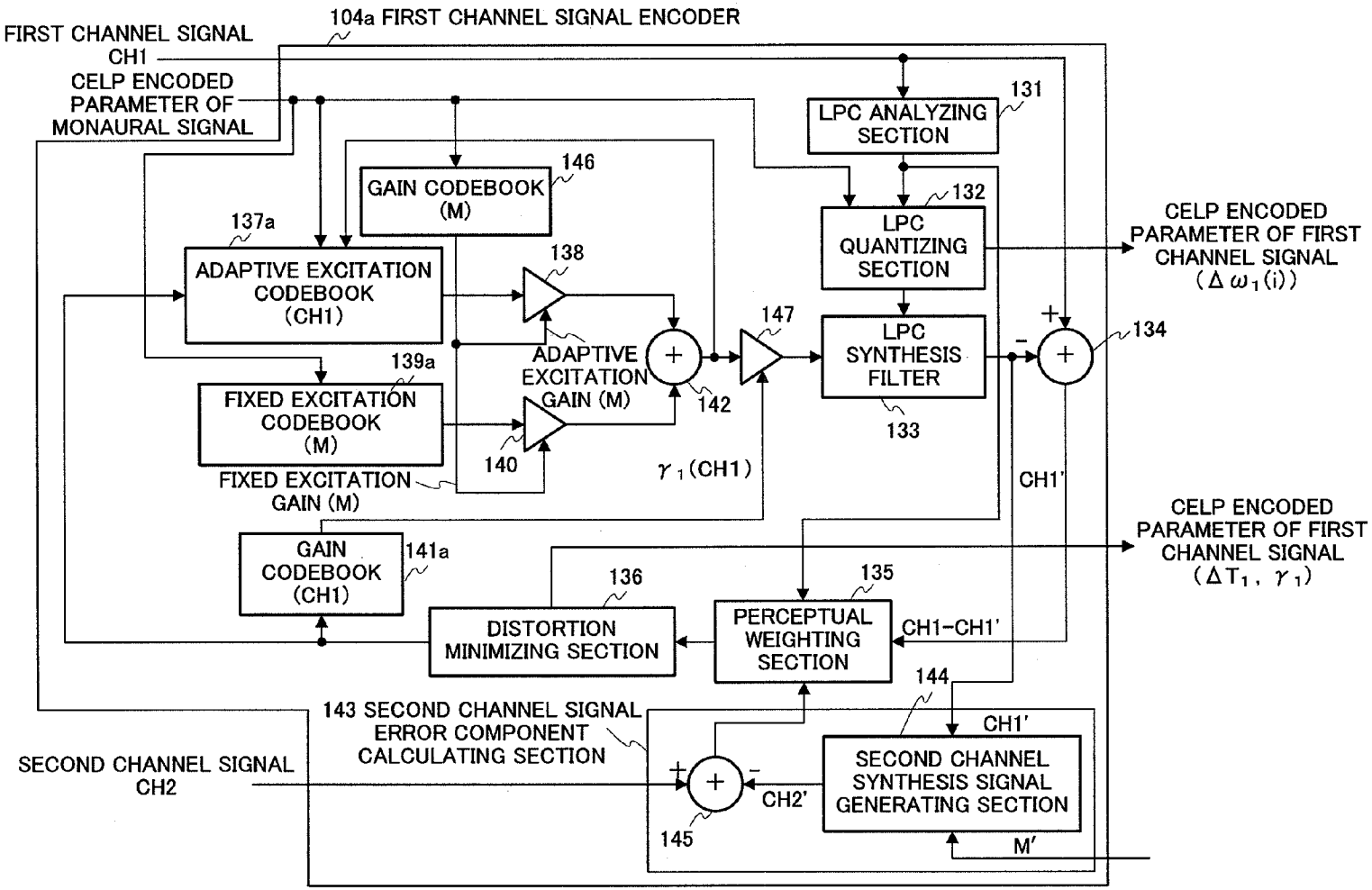
FIG. 7 is a block diagram showing the main internal configuration of the first channel signal encoder according to embodiment 2.

FIG. 7 is a block diagram showing the main internal configuration of first channel signal encoder 104*a*.

LPC quantizing section 132 calculates the difference LPC parameter between an LPC parameter of first channel signal CH1 obtained by LPC analyzing section 131 and an LPC parameter of the monaural signal already calculated by monaural signal CELP encoder 103, and quantizes the difference to obtain the final LPC parameter of the first channel.

The excitation is searched as follows. Adaptive excitation codebook 137*a* indicates the adaptive codebook lag of first channel CH1 as the adaptive codebook lag of the monaural signal and a difference lag parameter with respect to the adaptive codebook lag of the monaural signal. Fixed excitation codebook 139*a* uses the fixed excitation codebook index for monaural signal M which is used in fixed excitation codebook 119 of monaural signal CELP encoder 103A, as the fixed excitation codebook index of CH1. Specifically, fixed excitation codebook 139*a* uses the same index as that obtained in encoding of the monaural signal as the fixed excitation vector.

The excitation gain is expressed by the product of the adaptive excitation gain obtained by encoding monaural signal M, and a gain multiplier multiplied by the adaptive excitation gain; or the product of the fixed excitation gain obtained by encoding monaural signal M, and again multiplier (which is the same as that multiplied by the adaptive excitation gain) to be multiplied by the fixed excitation gain. This gain multiplier is encoded.

Figure 8:
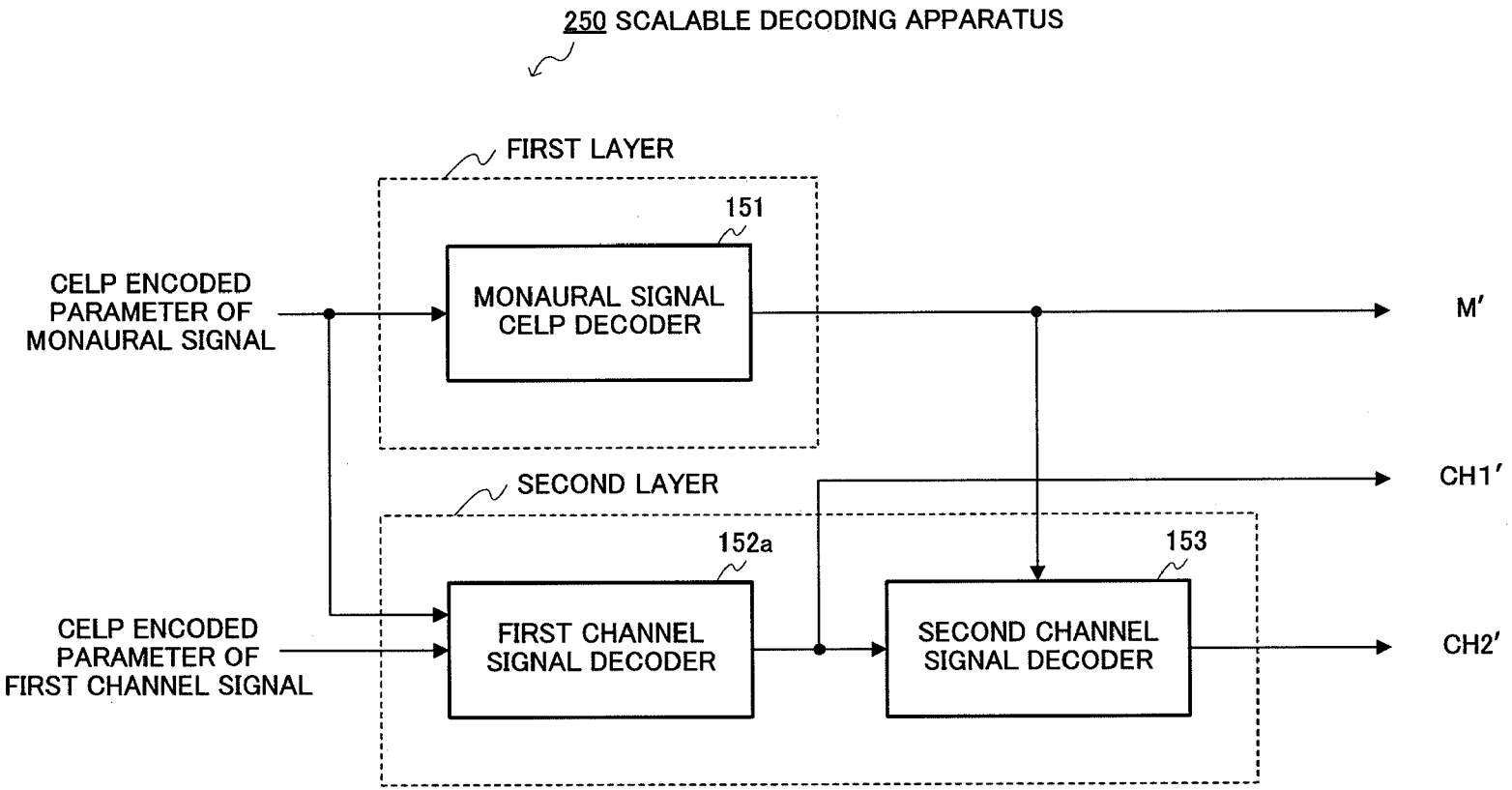
FIG. 8 is a block diagram showing the main configuration of the scalable decoding apparatus according to embodiment 2.

FIG. 8 is a block diagram showing the main configuration of scalable decoding apparatus 250 that corresponds to scalable encoding apparatus 200 described above.

First channel signal decoder 152*a* synthesizes first channel signal CH1' from both the CELP encoded parameter of the monaural signal and the CELP encoded parameter of the first channel signal.

In this way, according to this embodiment, when CH1 is encoded in the second layer, the difference parameter relative to the monaural signal is encoded, so that it is possible to perform more efficient encoding.

Embodiments 1 and 2 according to the present invention were described above.

The scalable encoding apparatus and scalable decoding apparatus according to the present invention are not limited to the embodiments described above, and may include various types of modifications.

The scalable encoding apparatus and scalable decoding apparatus according to the present invention can also be provided in a communication terminal apparatus and a base station apparatus in a mobile communication system. By this means, it is possible to provide a communication terminal apparatus and a base station apparatus that have the same operational advantages as those described above.

In the embodiments described above, monaural signal M was the average signal of CH1 and CH2, but this is by no means limiting.

The adaptive excitation codebook is also sometimes referred to as an adaptive codebook. The fixed excitation codebook is also sometimes referred to as a fixed codebook, a noise codebook, a stochastic codebook or a random codebook.

The case has been described as an example where the present invention is implemented with hardware, the present invention can be implemented with software.

Furthermore, each function block used to explain the above-described embodiments is typically implemented as an LSI constituted by an integrated circuit. These may be individual chips or may partially or totally contained on a single chip.

Here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2004-288327, filed on Sep. 30, 2004, the entire content of which is expressly incorporated by reference herein.

INDUSTRIAL APPLICABILITY

The scalable encoding apparatus, scalable encoding apparatus, and method according to the present invention can be applied to a communication terminal apparatus, a base station apparatus, or other apparatus that perform scalable encoding on a stereo signal using CELP encoding in a mobile communication system.

The invention claimed is:

1. A scalable encoding apparatus, comprising:

a generator that generates a monaural speech signal from a stereo speech signal that includes a first channel signal and a second channel signal;

a monaural encoder that encodes the monaural speech signal using a CELP method;

a calculator that calculates encoding distortion of the second channel signal that occurs by the CELP method; and a first channel encoder that encodes the first channel signal using the CELP method and obtains an encoded parameter of the first channel signal to minimize a sum of encoding distortion of the first channel signal that occurs by the CELP method and the encoding distortion of the second channel signal calculated by the calculator.

2. The scalable encoding apparatus according to claim 1, wherein:

the monaural encoder generates a synthesized monaural signal using an encoded parameter obtained by encoding the monaural speech signal using the CELP method;

the first channel encoder generates a synthesized first channel signal using the encoded parameter obtained by encoding the first channel signal using the CELP method; and the calculator generates a synthesized second channel signal using the synthesized monaural signal and the synthesized first channel signal, calculates a difference between the second channel signal and the synthesized second channel signal, and thereby calculates the encoding distortion of the second channel signal that occurs by the CELP method.

3. The scalable encoding apparatus according to claim 1, wherein encoding is not performed on the second channel signal.

4. The scalable encoding apparatus according to claim 1, wherein the sum is a sum of the weighted distortion of the encoding distortion of the first channel signal and the encoding distortion of the second channel signal.

5. The scalable encoding apparatus according to claim 1, wherein:

the monaural encoder outputs an encoded parameter, obtained by performing linear prediction analysis on the monaural speech signal, to the first channel encoder; and the first channel encoder encodes a difference between an encoded parameter obtained by performing linear prediction analysis on the first channel signal and the encoded parameter output from the monaural encoder.

6. A scalable decoding apparatus that corresponds to the scalable encoding apparatus according to claim 5, the scalable decoding apparatus comprising:

a monaural decoder that decodes the monaural speech signal using the encoded parameter output from the monaural encoder;

a first channel decoder that decodes the first channel signal of the stereo speech signal using the encoded parameter output from the monaural encoder and the encoded parameter obtained by the first channel encoder; and a second channel decoder that decodes the second channel signal of the stereo speech signal using the monaural speech signal and the first channel signal of the stereo speech signal.

7. The scalable encoding apparatus according to claim 1, wherein:

the monaural encoder outputs an encoded parameter, obtained by searching an adaptive excitation codebook for the monaural speech signal, to the first channel encoder; and the first channel encoder encodes a difference between a parameter obtained by searching the adaptive excitation codebook for the first channel signal and the encoded parameter output from the monaural encoder.

8. A scalable decoding apparatus that corresponds to the scalable encoding apparatus according to claim 7, the scalable decoding apparatus comprising:

a monaural decoder that decodes the monaural speech signal using the encoded parameter output from the monaural encoder;

a first channel decoder that decodes the first channel signal of the stereo speech signal using the encoded parameter output from the monaural encoder and the encoded parameter obtained by the first channel encoder; and a second channel decoder that decodes the second channel signal of the stereo speech signal using the monaural speech signal and the first channel signal of the stereo speech signal.

9. The scalable encoding apparatus according to claim 1, wherein:

the monaural encoder outputs a fixed excitation codebook index, obtained by searching a fixed excitation codebook for the monaural speech signal, to the first channel encoder; and the first channel encoder uses the fixed excitation codebook index output from the first channel encoder as a fixed excitation codebook index of the first channel signal.

10. A scalable decoding apparatus that corresponds to the scalable encoding apparatus according to claim 9, the scalable decoding apparatus comprising:

a monaural decoder that decodes the monaural speech signal using the encoded parameter output from the monaural encoder;

a first channel decoder that decodes the first channel signal of the stereo speech signal using the encoded parameter output from the monaural encoder and the encoded parameter obtained by the first channel encoder; and a second channel decoder that decodes the second channel signal of the stereo speech signal using the monaural speech signal and the first channel signal of the stereo speech signal.

11. The scalable encoding apparatus according to claim 1, wherein the generator obtains an average of the first channel signal and the second channel signal and sets the average as the monaural speech signal.

12. A scalable decoding apparatus that corresponds to the scalable encoding apparatus according to claim 1, the scalable decoding apparatus comprising:

a monaural decoder that decodes the monaural speech signal using an encoded parameter output from the monaural encoder;

a first channel decoder that decodes the first channel signal of the stereo speech signal using the encoded parameter obtained by the first channel encoder; and a second channel decoder that decodes the second channel signal of the stereo speech signal using the monaural speech signal and the first channel signal of the stereo speech signal.

13. A communication terminal apparatus comprising the scalable decoding apparatus according to claim 12.

14. A base station apparatus comprising the scalable decoding apparatus according to claim 12.

15. A communication terminal apparatus comprising the scalable encoding apparatus according to claim 1.

16. A base station apparatus comprising the scalable encoding apparatus according to claim 1.

17. A scalable encoding method, comprising:

generating, with one of at least one circuit and at least one processor, a monaural speech signal from a stereo speech signal that includes a first channel signal and a second channel signal;

encoding, with one of the at least one circuit and the at least one processor, the monaural speech signal using a CELP method;

calculating, with one of the at least one circuit and the at least one processor, encoding distortion of the second channel signal that occurs by the CELP method; and encoding, with one of the at least one circuit and the at least one processor, the first channel signal using the CELP method and obtaining an encoded parameter of the first channel signal to minimize a sum of encoding distortion of the first channel signal that occurs by the CELP method and the encoding distortion of the second channel signal calculated by the calculating.

18. A scalable decoding method that corresponds to the scalable encoding method according to claim 17, the scalable decoding method comprising:

decoding, with one of the at least one circuit and the at least one processor, the monaural speech signal using an encoded parameter generated in the encoding the monaural speech signal;

decoding, with one of the at least one circuit and the at least one processor, the first channel signal of the stereo speech signal using the encoded parameter obtained in the encoding the first channel signal; and decoding, with one of the at least one circuit and the at least one processor, the second channel signal of the stereo speech signal using the monaural speech signal and the first channel signal of the stereo speech signal.

* * * * *